US011421575B2

(12) United States Patent
Neville et al.

(10) Patent No.: US 11,421,575 B2
(45) Date of Patent: Aug. 23, 2022

(54) EMISSION TREATMENT COMPONENT SUPPORT STRUCTURE

(71) Applicant: Ford Global Technologies, LLC, Dearborn, MI (US)

(72) Inventors: Daniel Neville, Wickford (GB); Jonathan Mooney, Epping (GB); Liam Maloney, Billericay (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/062,691

(22) Filed: Oct. 5, 2020

(65) Prior Publication Data

US 2022/0106898 A1 Apr. 7, 2022

(51) Int. Cl.
*F01N 3/28* (2006.01)
*F01N 3/20* (2006.01)

(52) U.S. Cl.
CPC ..... *F01N 3/2835* (2013.01); *F01N 3/2013* (2013.01); *F01N 2240/16* (2013.01); *F01N 2330/10* (2013.01)

(58) Field of Classification Search
CPC . F01N 3/2013; F01N 2240/16; F01N 2330/10
USPC ..... 422/179
See application file for complete search history.

(56) References Cited

U.S. PATENT DOCUMENTS

| | | | | |
|---|---|---|---|---|
| 5,380,580 | A * | 1/1995 | Rogers | D04H 1/4209 428/920 |
| 6,092,622 | A * | 7/2000 | Hiers | G10K 11/162 181/290 |
| 6,942,708 | B2 | 9/2005 | Peter et al. | |
| 8,124,023 | B2 * | 2/2012 | Ohshika | F01N 3/0211 422/179 |
| 8,734,726 | B2 * | 5/2014 | Kumar | F01N 3/2853 422/179 |
| 9,416,053 | B2 * | 8/2016 | Kunze | D04H 1/732 |
| 2017/0260887 | A1 * | 9/2017 | Takase | F01N 3/2828 |
| 2020/0002861 | A1 * | 1/2020 | de Rovere | D04H 3/105 |
| 2021/0298128 | A1 * | 9/2021 | Welder | H05B 3/56 |

* cited by examiner

*Primary Examiner* — Tom P Duong
(74) *Attorney, Agent, or Firm* — Haley Guiliano LLP

(57) ABSTRACT

An emission treatment component support structure for an exhaust system, the support structure comprising: an insulating layer configured to support a substrate of the emission treatment component within a housing; and one or more resistive metal elements provided at least partially within the insulating layer.

10 Claims, 9 Drawing Sheets

EMISSION TREATMENT COMPONENT SUPPORT STRUCTURE

BACKGROUND

The present disclosure relates to an emission treatment component support structure and, more particularly, but not exclusively, to systems and methods related to emission treatment component support structures for exhaust systems comprising means to heat the support structure.

SUMMARY

The need for reduced engine emissions has led to engine exhaust systems that comprise emission treatment components, such as catalytic converters, particle filters and NOx traps. These emission treatment components are located within a structure/housing in the exhaust system, such as a can that is designed to contain and direct exhaust gases over and/or through the emission treatment component. A support structure, such as a support mat, is typically used to hold the emission treatment component in a desired location within the exhaust system (e.g., in-between the inner wall of a can and the surface of the emission treatment component).

The performance of an emission treatment component is commonly improved when the exhaust system is at a higher temperature or heat is applied to the emission treatment component. For example, a catalytic converter is more efficient at reducing pollutants at higher temperatures, and particulates entrapped in a particle filter can be burnt off by heating the particulate filter. However, inclusion of a heater element for heating the emission treatment component typically adds cost and increases complexity and the package size of the exhaust system.

In view of the foregoing, the present disclosure provides an emission treatment component support structure that improves the performance of an emission treatment component supported thereby and that is less complex and expensive than conventional systems.

In accordance with a first aspect of the disclosure, there is provided an emission treatment component support structure for an exhaust system, the support structure comprising: an insulating layer configured to support a substrate (and/or substrate assembly) of the emission treatment component within a housing, e.g., of the exhaust system; and one or more resistive metal elements provided at least partially within and/or at least partially covering a surface of the insulating layer.

Such a support structure is relatively simple to make and utilize in existing exhaust systems. In use, the support structure is typically used to hold an emission treatment component in a desired location within the exhaust system. Emission treatment components are typically located within a structure/housing in the exhaust system, such as a can that is designed to contain and direct exhaust gases over and/or through the emission treatment component. The support structure may be a support mat. The support structure may completely surround, e.g., in a circumferential direction, the emission treatment component. Alternatively, the support structure may partially surround, e.g., in a circumferential direction, the emission treatment component. In use, heat can be applied to the emission treatment component via the one or more resistive metal elements, thereby improving the efficiency of the emission treatment component.

In some variations, the support structure may comprise means for applying an electrical current through the one or more resistive metal elements. The means for applying an electrical current may comprise coupling the support structure to a vehicle power system. Additionally or alternatively, the means for applying an electrical current may comprise coupling the support structure to a standalone power supply, such as a battery or an ultracapacitor. An advantage of a standalone power system is that it reduces power drain when a vehicle is being started and can be charged when vehicle power requirements are relatively lower.

In some variations, the one or more resistive metal elements may comprise a plurality of continuous metal elements incorporated, e.g., woven, within the support structure, e.g., in a regular pattern. For example, if the support structure is a woven material, the metal elements may be introduced when the support structure is woven such that the metal elements are woven within the material that makes up the support structure. Alternatively, at least some of the warp or/and the weft may comprise metal elements. In some examples, if the support structure comprises compressed fibers, then the metal elements may be introduced such that they are compressed along with the fibers that make up the support structure. In the context of the present disclosure, a regular pattern is a pattern that repeats at regular intervals and/or has at least one order of symmetry. An advantage of utilizing a plurality of continuous metal elements incorporated within the support structure in a regular pattern is that, in use, heat is applied to the emission treatment component in a uniform manner.

In some variations, the one or more resistive metal elements may comprise a plurality of metal filings. The metal filings may be incorporated within the support structure in a continuous regular pattern. In the context of the present disclosure, a continuous pattern is one that extends without a break from a first point/area in the support structure to a second point/area in the support structure (e.g., at least one path is formed between the first and the second points). In this way, in use, an electrical current can be applied at the first and second points/areas and the metal filings will conduct the electrical current. As before, a regular pattern (of filings) is a pattern that repeats at regular intervals and/or has at least one order of symmetry. The metal filings may be present throughout, e.g., throughout the thickness and/or length, the support structure, depending on how the filings are incorporated into the support structure. An advantage of a utilizing a plurality of metal filings incorporated within the support structure in a regular pattern is that, in use, heat is applied to the emission treatment component in a uniform manner.

In some variations, the one or more resistive metal elements may comprise a plurality of continuous metal elements incorporated within the support structure in an irregular manner. In the context of the present disclosure, an irregular manner is one that forms no obvious pattern and/or does not (intentionally) have any order of symmetry. An advantage of utilizing a plurality of continuous metal elements incorporated within the support structure in an irregular pattern is that the incorporated metal elements can be arranged to accommodate emission treatment components that have an irregular shape.

In some variations, the one or more resistive metal elements may comprise a plurality of metal filings and the metal filings are incorporated within the support structure in a continuous, irregular manner. In the context of the present disclosure, a continuous manner is one that extends without a break from a first point/area in the support structure to a second point/area in the support structure (i.e. at least one path is formed between the first and the second points). In this way, in use, an electrical current can be applied at the first and second points/areas and the metal filings will conduct the electrical current. As before, an irregular manner is one that forms no obvious pattern and/or does not typically have any order of symmetry. An advantage of a utilizing a plurality of continuous metal elements incorporated within the support structure in an irregular pattern is that the incorporated metal elements can be arranged to accommodate emission treatment components that have an irregular shape.

In some variations, the one or more resistive metal elements may comprise a continuous mesh that is incorporated at least partially within the support structure. An advantage of utilizing a continuous mesh incorporated at least partially within the support structure is that, in use, heat is applied to the emission treatment component in a uniform manner, e.g., depending on the density of the mesh.

In some variations, the one or more resistive metal elements may be a continuous mesh layer. At least a part of the continuous mesh layer may be attached to a surface of the support structure.

In some variations, the one or more resistive metal elements may be formed in a regular pattern in one part of the support mat and may be formed in an irregular pattern in another part of the support mat. In some variations, a support mat may comprise a regular pattern, with parts comprising an irregular pattern overlaid. This may be useful as the regular pattern delivers a uniform heat to the emission treatment component and the irregular pattern can be used to apply more heat to parts of the emission treatment component that require more heating.

It is relatively simple to replace a standard support structure with any of the aforementioned variations, not least because the overall package size of the support structure and the resistive metal elements is similar to or is the same as a standard support structure. Where the metal elements are incorporated into the support structure, this may provide additional strength to the support structure. The aforementioned support structures are able to utilize existing assembly methods and tooling, which makes the support structures relatively simple to assemble.

In some variations, the support structure may comprise a first support structure portion and a second support structure portion. The one or more resistive metal elements may be a continuous mesh layer located between the first support structure portion and the second support structure portion. It is relatively simple to assemble such a support structure using existing assembly methods and tooling. Further, it is also relatively simple to replace a standard support structure with a support structure comprising such a mesh, as the mesh is simply attached to a surface of the support structure. An advantage of having both a first support structure portion and a second support structure portion is that, in use, the exhaust system is protected from the heat generated by the resistive metal elements.

In some variations, the insulating layer is not electrically conductive. An advantage of having an insulating layer that is not electrically conductive is that the exhaust system does not need to be insulated.

In accordance with a second aspect of the disclosure, there is provided a method of heating an emission treatment component of an exhaust system, the method comprising: providing a support structure for the emission treatment component, the support structure comprising an insulating layer configured to support a substrate of the emission treatment component within a housing, and one or more resistive heating metal elements; and applying an electrical current through the one or more resistive metal elements.

In accordance with a third aspect of the disclosure, there is provided an emission treatment component comprising at least one of the aforementioned support structures.

In accordance with a fourth aspect of the disclosure, there is provided a vehicle comprising at least one of the aforementioned emission treatment component support structures and/or the aforementioned at least one of the aforementioned emission treatment components.

FIGURES

The above and other objects and advantages of the disclosure will be apparent upon consideration of the following detailed description, taken in conjunction with the accompanying drawings, in which:

FIG. 1*a* shows a top view of a support structure and an emission treatment component, in accordance with an example of the disclosure.

FIG. 1*b* shows a side view of a support structure and an emission treatment component, in accordance with an example of the disclosure.

FIG. 1*c* shows a cross-sectional view of a support structure and an emission treatment component, in accordance with an example of the disclosure.

FIG. 2*a* shows a top view of a support structure and an emission treatment component, in accordance with an example of the disclosure.

FIG. 2*b* shows a side view of a support structure and an emission treatment component, in accordance with an example of the disclosure.

FIG. 2*c* shows a cross-sectional view of a support structure and an emission treatment component, in accordance with an example of the disclosure.

FIG. 3 is a schematic diagram of a support structure and an emission treatment component being inserted into a part of an exhaust system, in accordance with an example of the disclosure.

FIG. 4*a* is a schematic diagram showing a cross-sectional view of a support structure comprising a plurality of continuous metal elements arranged in a regular pattern, in accordance with an example of the disclosure.

FIG. 4*b* is a schematic diagram showing a cross-sectional view of a support structure comprising a plurality of metal filings arranged in a continuous regular pattern, in accordance with an example of the disclosure.

FIG. 4*c* is a schematic diagram showing a cross-sectional view of a support structure comprising a plurality of continuous metal elements arranged in an irregular pattern, in accordance with an example of the disclosure.

FIG. 4*d* is a schematic diagram showing a cross-sectional view of a support structure comprising a plurality of metal filings arranged in a continuous irregular pattern, in accordance with an example of the disclosure.

FIG. 4*e* is a schematic diagram showing a cross-sectional view of a support structure comprising a continuous mesh, in accordance with an example of the disclosure.

FIG. 4*f* is a schematic diagram showing a cross-sectional view of a continuous mesh that is attached to a surface of the support structure, in accordance with an example of the disclosure.

DETAILED DESCRIPTION

Figure 1A:
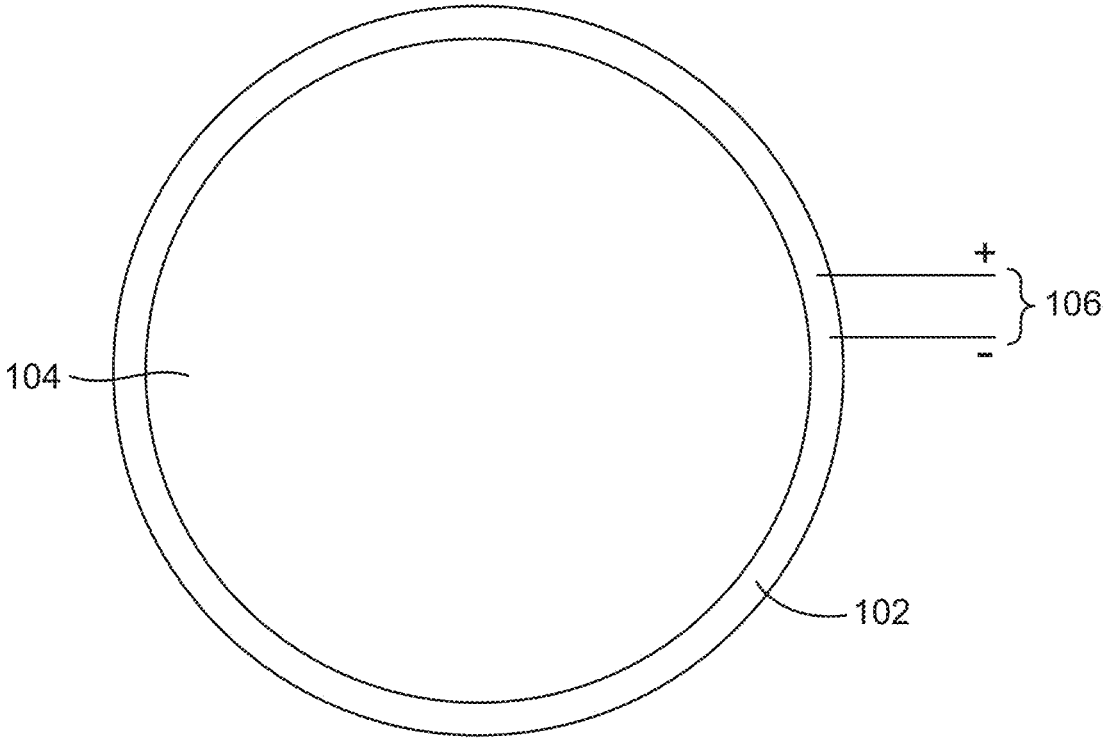

FIG. 1*a* is a schematic diagram of a top view of a support structure 102 and a substrate 104 of an emission treatment component. The support structure 102 comprises metallic elements, e.g., metallic strands/fibers, and surrounds the substrate 104 of the emission treatment component in a continuous circumferential manner, such that a first surface of the support structure 102 is in contact with a first surface of the substrate 104 of the emission treatment component. However, it is contemplated that in some examples the support structure does not completely surround the emission treatment component. In some examples, the support structure may comprise a plurality of continuous metal elements incorporated within the support structure in a regular or an irregular pattern. In some examples, the support structure may comprise a plurality of metal filings incorporated within the support structure in a continuous regular or irregular pattern. In some examples, the support structure may comprise a mesh incorporated within the support structure. An optional electrical input 106 is coupled to the support structure 102 and is used for applying an electrical current to the metallic elements, and hence generating heat, in use. In use, the generated heat is used to increase the temperature of the emission treatment component, thereby increasing the efficiency of the emission treatment component, e.g., depending on the operating conditions of an exhaust system in which the emission treatment component is incorporated.

Figure 1B:
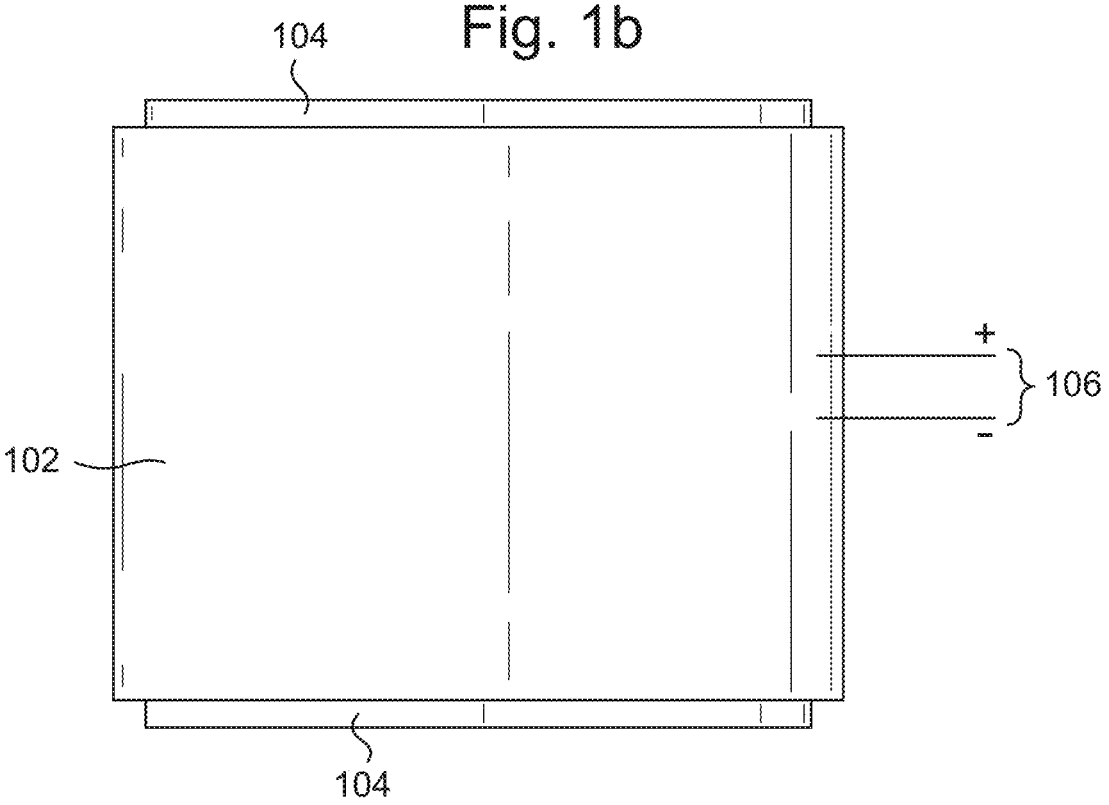

FIG. 1*b* is a schematic diagram of a side view of the support structure 102 and the substrate 104 of the emission treatment component of FIG. 1*a*. As can been seen, the substrate 104 of the emission treatment component may extend away from the support structure 102 in a first direction and in an opposing second direction, such that the support structure 102 does not cover the entire first surface of the emission treatment component.

Figure 1C:
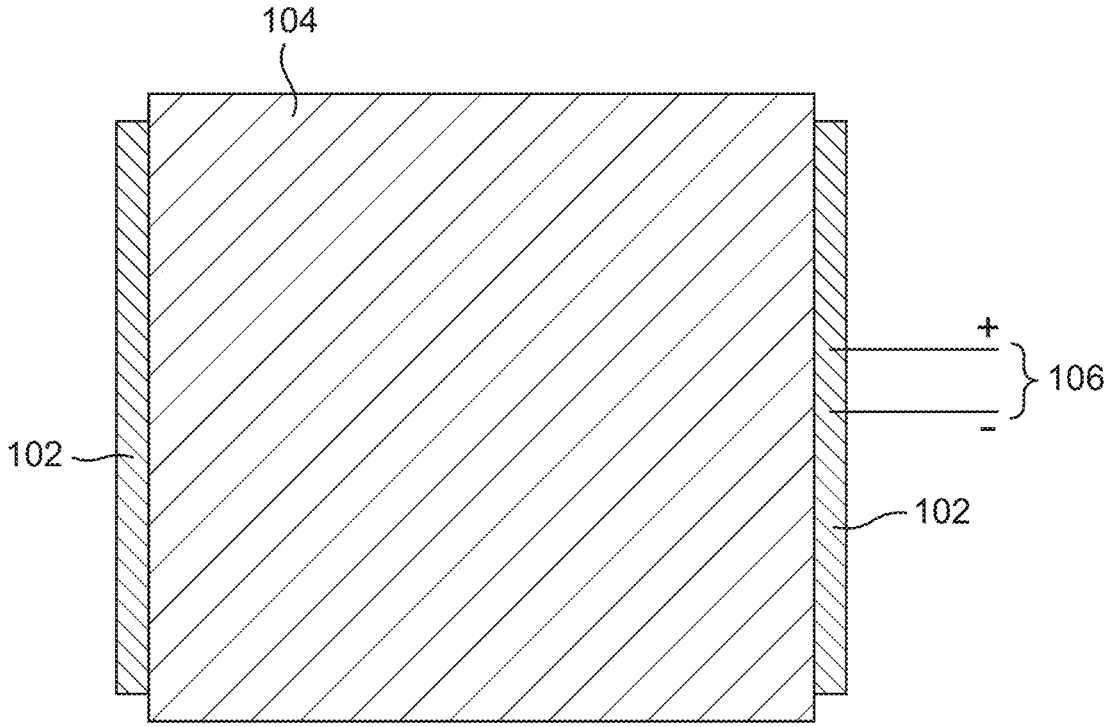

FIG. 1*c* is a schematic diagram of a cross-sectional view of the support structure 102 and the substrate 104 of the emission treatment component of FIGS. 1*a* and 1*b*.

Figure 2A:
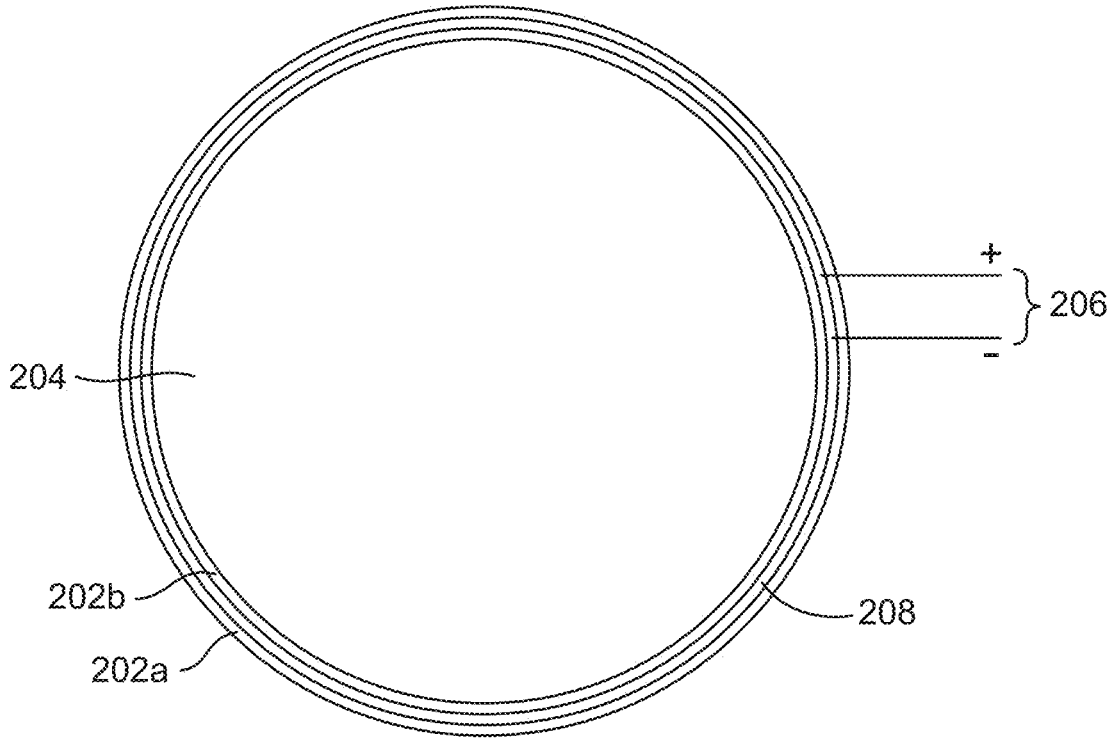

FIG. 2*a* is a schematic diagram of a top view of a support structure and a substrate 204 of an emission treatment component. The support structure comprises a first support structure portion 202*a*, a metallic element 208 and a second support structure portion 202*b*. The metallic element 208 is located, e.g., sandwiched, in-between the first and second support structure portions 202. The support structure 202 circumferentially surrounds the substrate 204 of the emission treatment component in a continuous manner, such that a first surface of the first support structure portion 202*b* is in contact with a first surface of the substrate 204 of the emission treatment component. The depicted support structure 102 comprises a continuous metallic mesh. An optional electrical input 106 is coupled to the mesh and is used for applying an electrical current to the metallic elements, in use. An optional electrical input 206 is coupled to the mesh and is used for applying an electrical current to the mesh, and hence generating heat, in use. In use, the generated heat is used to increase the temperature of the emission treatment component, thereby increasing the efficiency of the emission treatment component.

Figure 2B:
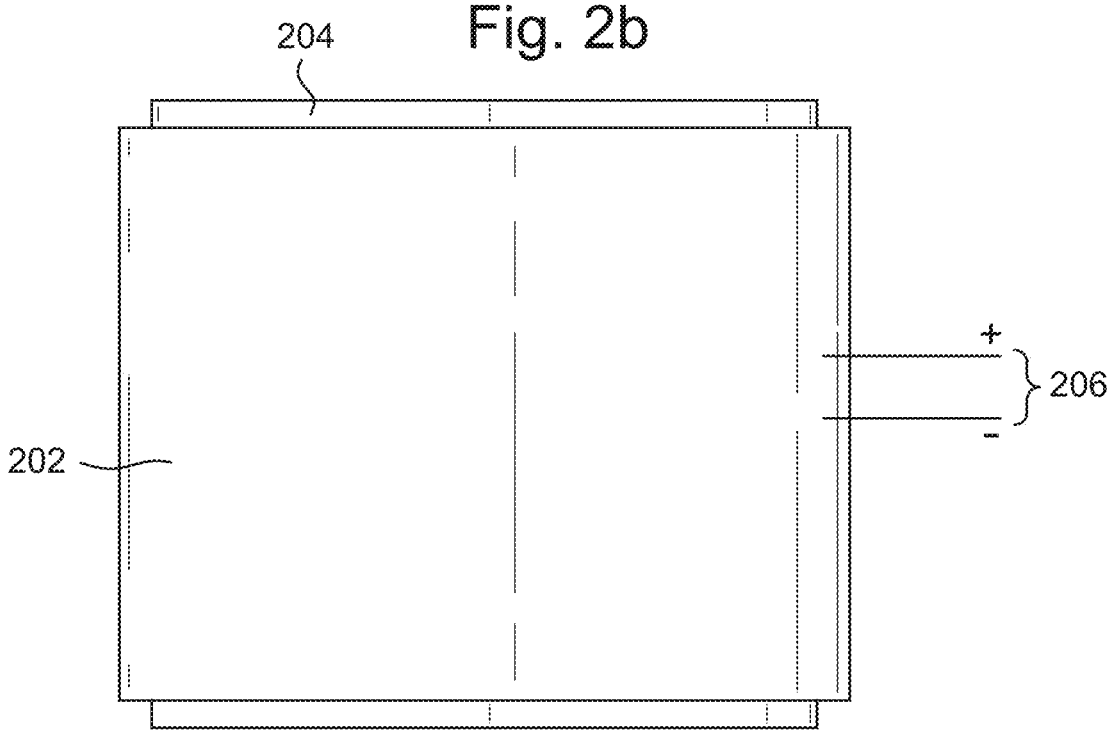

FIG. 2*b* is a schematic diagram of a side view of the support structure 202 and the substrate 204 of the emission treatment component of FIG. 2*a*. As can been seen, the substrate 204 of the emission treatment component may extend away from the support structure 202 in a first direction and in an opposing second direction, such that the support structure 202 does not cover the entire first surface of the emission treatment component.

Figure 2C:
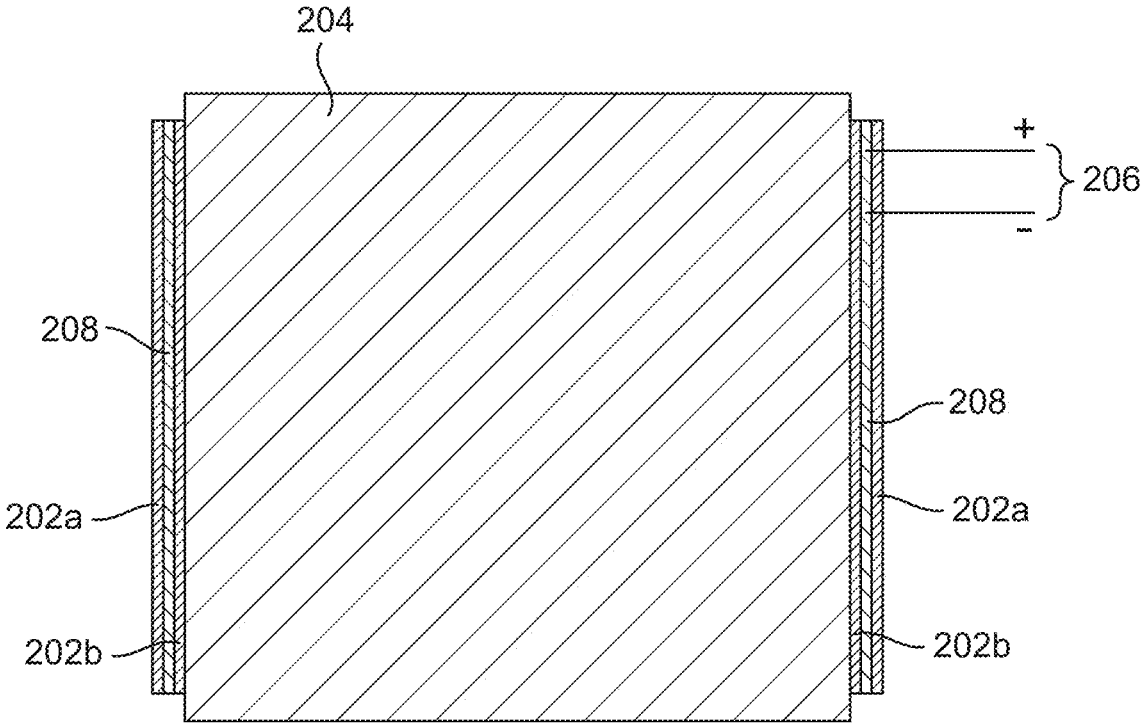

FIG. 2*c* is a schematic diagram of a cross-sectional view of the support structure 202 and the substrate 204 of the emission treatment component of FIGS. 2*a* and 2*b*.

Figure 3:
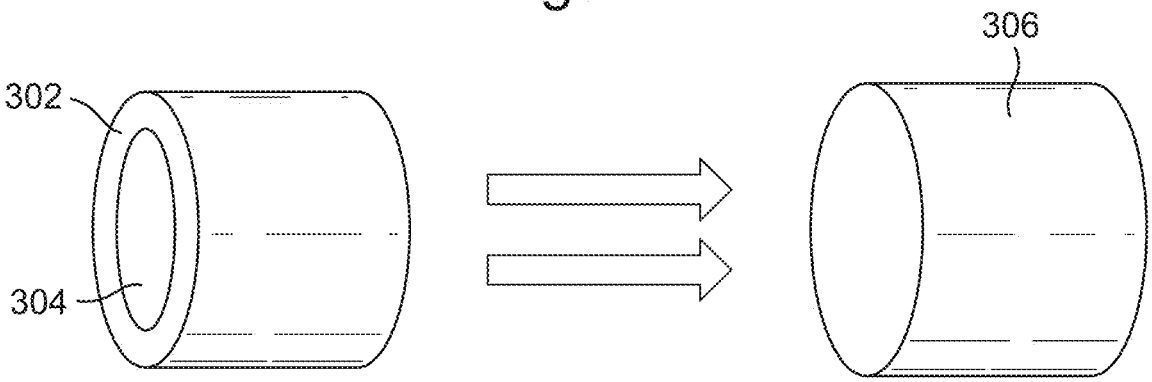

FIG. 3 is a schematic diagram of a support structure and an emission treatment component being inserted into a part of an exhaust system. In use, the emission treatment component 304 is surrounded by a support structure 302. The support structure 302 and the emission treatment component 304 are placed in a structure 306 in the exhaust system, such as a can. The can contains and directs exhaust gases over and/or through the emission treatment component 304.

Figure 4A:
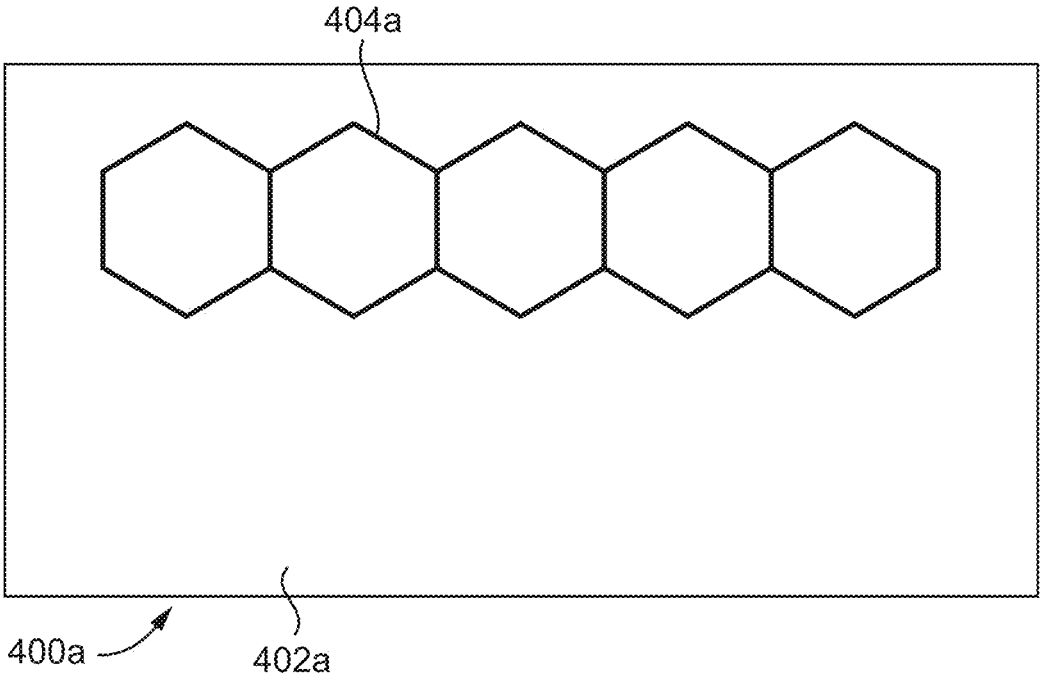

FIG. 4*a* is a schematic diagram showing a cross-sectional view of a support structure comprising a plurality of continuous metal elements arranged in a regular pattern. The support structure 402*a* comprises metallic elements 404*a*. The metallic elements are arranged in a regular pattern, e.g., a pattern that repeats at regular intervals and/or has at least one order of symmetry. Although hexagons are shown in FIG. 4*a*, the regular pattern may be any regular geometric shape or any other regular pattern. The metallic elements are arranged in a continuous manner as the pattern extends without a break from a first point/area in the support structure to a second point/area in the support structure. The support structure may comprise one or more patterns that are continuous. In some examples, the metallic elements may be arranged in a plurality of discrete patterns of metallic elements. For example, the support structure 402*a* may comprise a plurality of patterns of metallic elements 404*a* that do not touch one another.

Figure 4B:
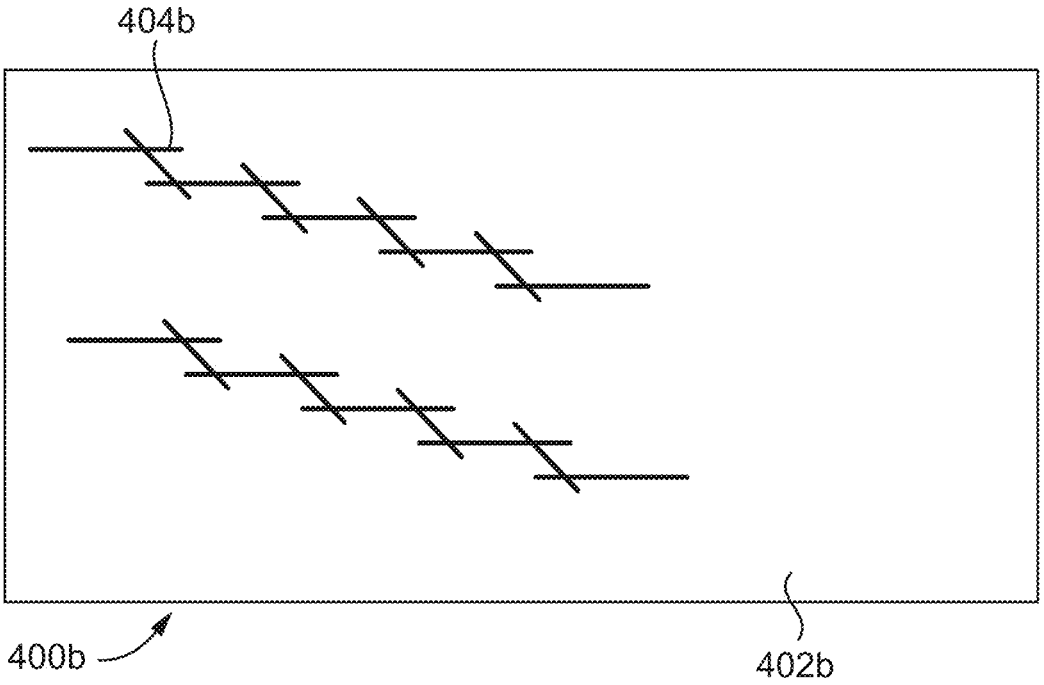

FIG. 4*b* is a schematic diagram showing a cross-sectional view of a support structure comprising a plurality of metal filings arranged in a continuous regular pattern. The support structure 402*b* comprises metallic filings 404*b*. The metal filings are arranged in a regular pattern. Although a particular pattern is shown in FIG. 4*b*, the regular pattern may be any regular geometric shape or any other regular pattern. The metallic filings are arranged in a continuous manner as the pattern extends without a break from a first point/area in the support structure to a second point/area in the support structure. The support structure may comprise one or more patterns that are continuous (e.g., not every metal filing needs to be connected to or touching every other metal filing).

Figure 4C:
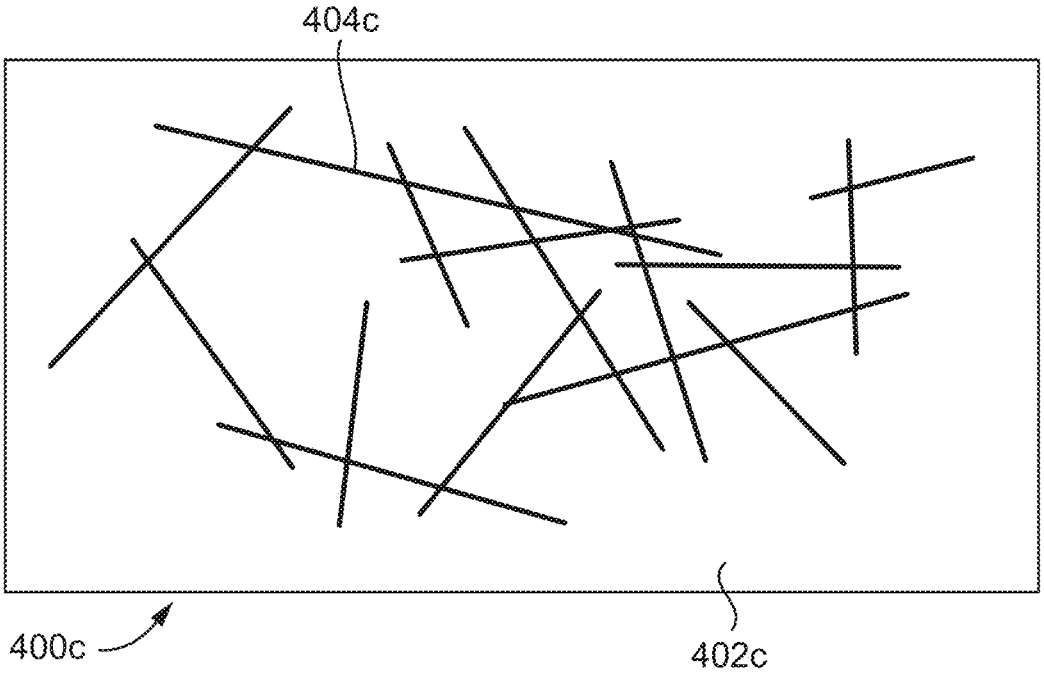

FIG. 4*c* is a schematic diagram showing a cross-sectional view of a support structure comprising a plurality of continuous metal elements arranged in an irregular pattern. The support structure 402*c* comprises metallic elements 404*c*. The metal elements are arranged in an irregular pattern. An irregular manner is one that forms no obvious pattern and/or does not (intentionally) have any order of symmetry. The metallic elements are arranged in a continuous manner as the irregular pattern extends without a break from a first point/area in the support structure to a second point/area in the support structure. The support structure may comprise one or more patterns that are continuous (e.g., not every metal element needs to be connected to or touching every other metal element).

Figure 4D:
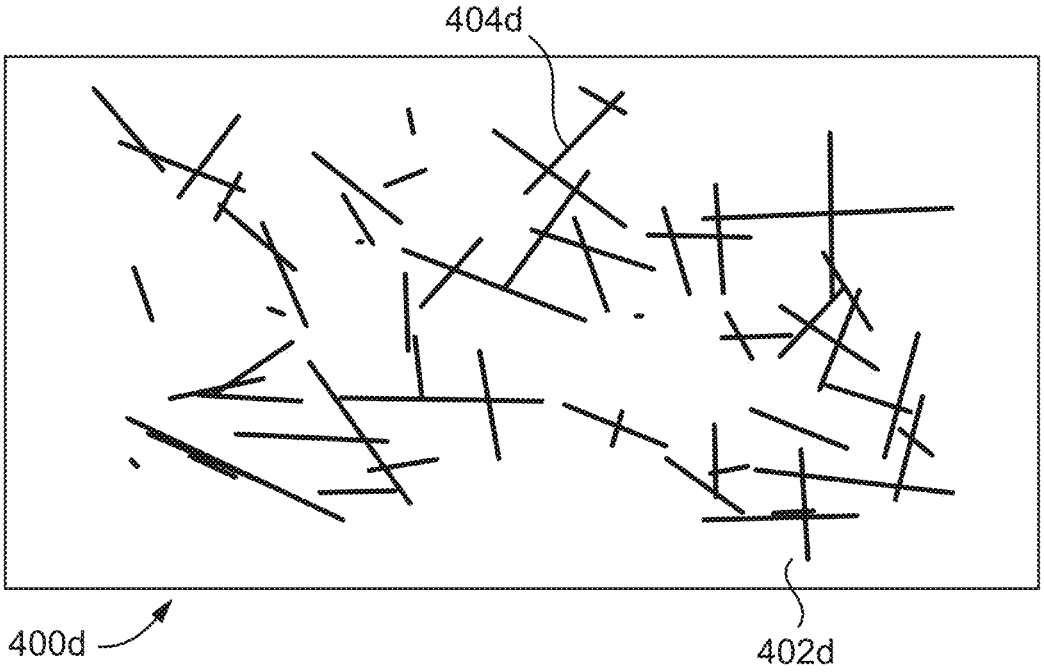

FIG. 4*d* is a schematic diagram showing a cross-sectional view of a support structure comprising a plurality of continuous metal elements arranged in an irregular pattern. The support structure 402*d* comprises metal filings 404*d*. The metal filings are arranged in an irregular pattern. The metallic filings are arranged in a continuous manner as the irregular pattern extends without a break from a first point/area in the support structure to a second point/area in the support structure. The support structure may comprise one or more patterns that are continuous (e.g., not every metal filing needs to be connected to or touching every other metal filing).

Figure 4E:
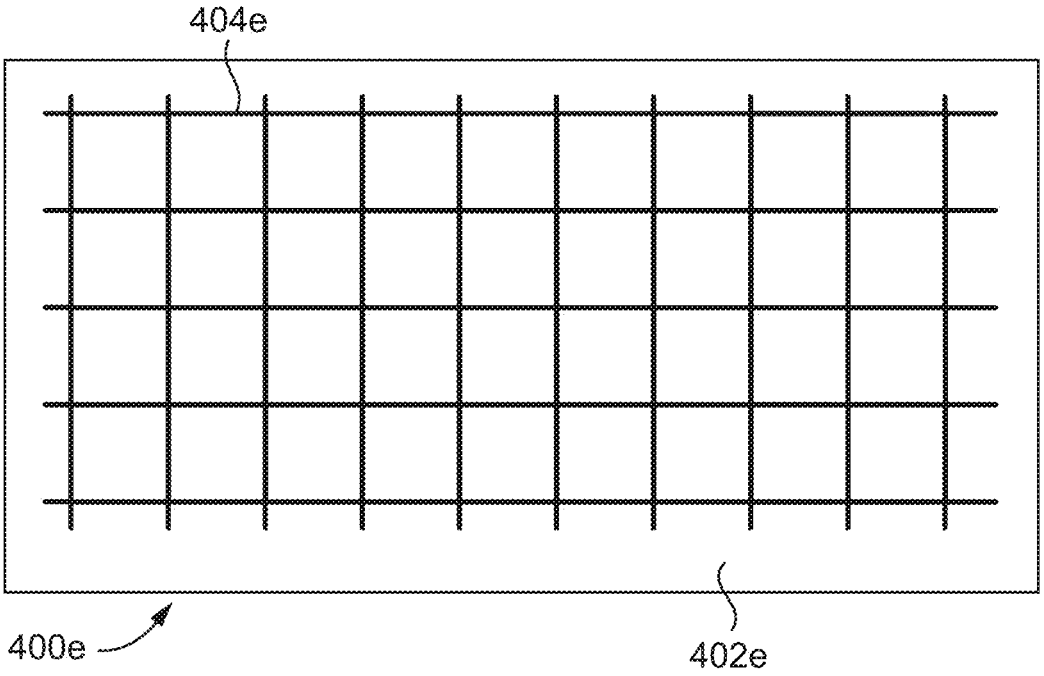

FIG. 4*e* is a schematic diagram showing a cross-sectional view of a support structure comprising a continuous mesh. The support structure 402*e* comprises a metal mesh 404*e*.

Figure 4F:
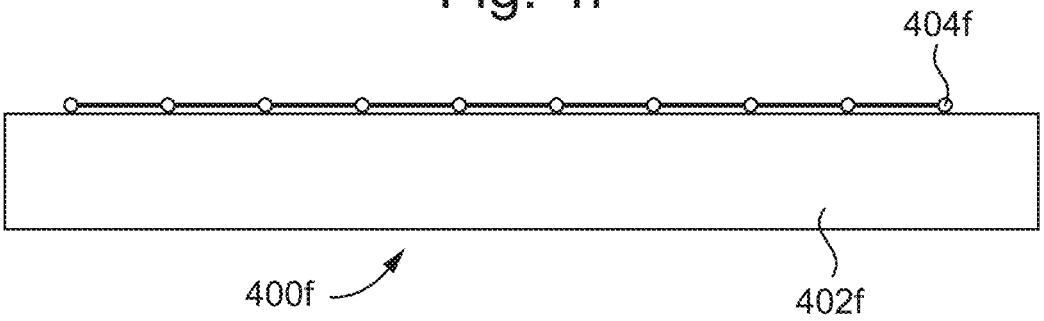

FIG. 4*f* is a schematic diagram showing a cross-sectional view of a continuous mesh that is attached to a surface of the support structure. A first surface of the support structure 402*f* has a metal mesh 404*e* attached to it.

Figure 5:
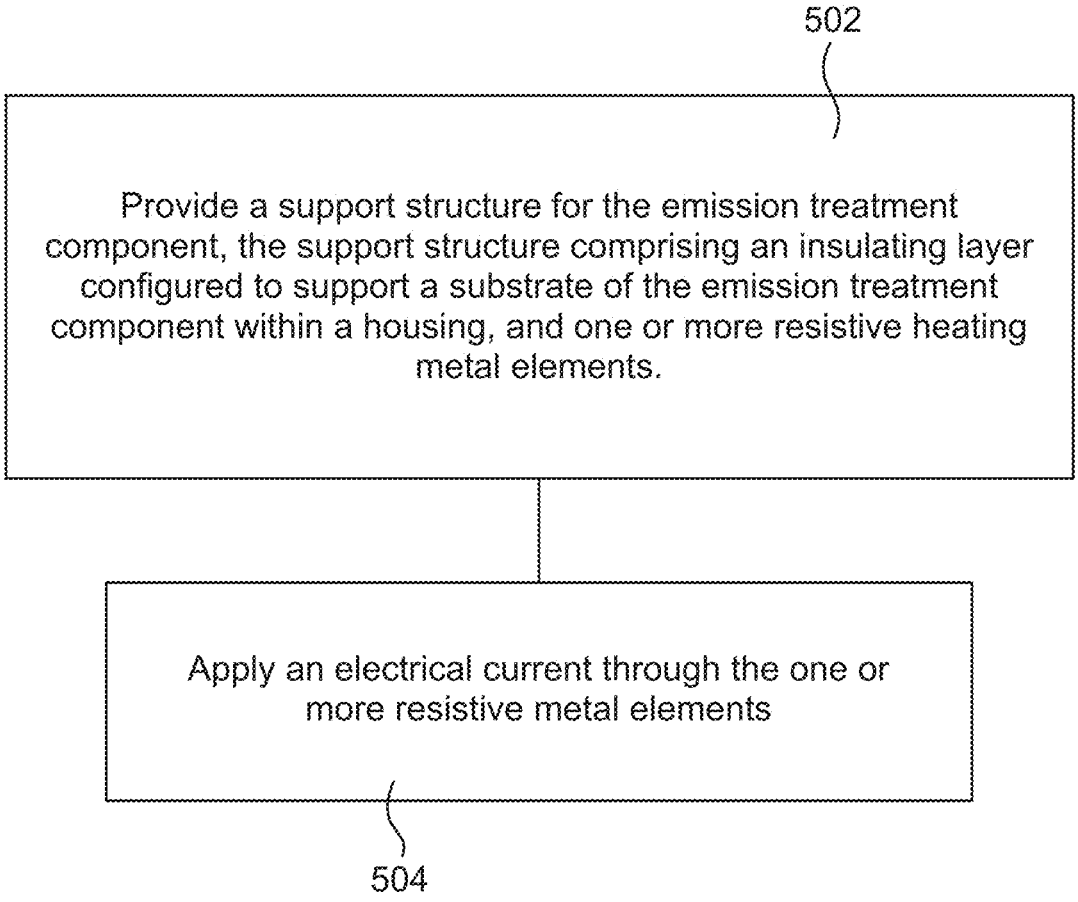
FIG. 5 shows method steps, in accordance with an example of the disclosure.

FIG. 5 describes a method 500 of heating an emission treatment component of an exhaust system. At 502, a support structure for the emission treatment component is provided, the support structure comprising an insulating layer configured to support a substrate of the emission treatment component within a housing, and one or more resistive heating metal elements. At 504, an electrical current is applied through the one or more resistive metal elements.

Figure 6:
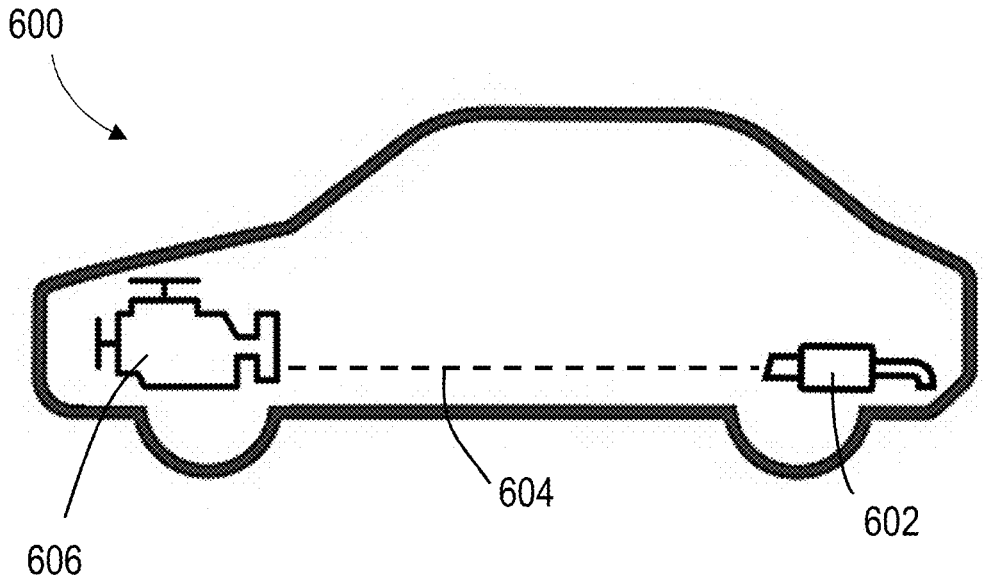
FIG. 6 shows a schematic diagram of a vehicle and an emission treatment component having an emission treatment component support structure, in accordance with an example of the disclosure.

FIG. 6 shows a schematic diagram of a vehicle 600 having an exhaust system 604 attached to an engine 606. The exhaust system 604 takes exhaust gases away from the engine 606 and comprises a housing 602 containing a support structure and a substrate of an emission treatment component. The support structure supports the substrate of the emission treatment component. The support structure may be as described above.

The processes described above are intended to be illustrative and not limiting. One skilled in the art would appreciate that the steps of the processes discussed herein may be omitted, modified, combined, and/or rearranged, and any additional steps may be performed without departing from the scope of the disclosure. More generally, the above disclosure is meant to be exemplary and not limiting. Furthermore, it should be noted that the features and limitations described in any one embodiment and/or example may be applied to any other embodiment and/or example herein, and flowcharts or examples relating to one embodiment and/or example may be combined with any other embodiment and/or example in a suitable manner, done in different orders, or done in parallel. In addition, the systems and methods described herein may be performed in real time. It should also be noted that the systems and/or methods described above may be applied to, or used in accordance with, other systems and/or methods.

The invention claimed is:

1. An emission treatment component support structure for an exhaust system, the support structure comprising:

an insulating layer configured to support a substrate of the emission treatment component within a housing; and a plurality of resistive metal elements provided at least partially within the insulating layer, wherein the plurality of resistive metal elements comprise:

a first continuous resistive metal element incorporated at least partially within the insulating layer in a regular pattern; and a plurality of second continuous restive metal elements each incorporated at least partially within the insulating layer in an irregular pattern, wherein the first continuous resistive metal element is in electrical communication with the plurality of second continuous resistive metal elements, and a location of the plurality of second continuous resistive metal elements is configured to correspond to only a part, or parts, of the emission treatment component.

2. The support structure of claim 1, further comprising means for applying an electrical current through the plurality of resistive metal elements.

3. The support structure of claim 1, wherein the first continuous resistive metal elements comprises a plurality of metal filings.

4. The support structure of claim 1, wherein the plurality of second continuous resistive metal elements comprise a plurality of metal filings.

5. The support structure of claim 1, wherein at least one of the first and the second continuous resistive metal elements comprise a continuous mesh.

6. The support structure of claim 1, wherein at least one of the first and second continuous resistive metal elements is a continuous mesh layer and at least a part of the continuous mesh layer is attached to a surface of the insulating layer.

7. The support structure of claim 1, wherein the support structure comprises a first support structure portion and a second support structure portion and wherein at least one of the first and second continuous resistive metal elements is a continuous mesh layer located between the first support structure portion and the second support structure portion.

8. The support structure of claim 1, wherein the insulating layer is not electrically conductive.

9. An exhaust system comprising at least one emission treatment component support structure according to claim 1.

10. A vehicle comprising at least one of the emission treatment component support structures of claim 1.

* * * * *